US011794487B2

(12) United States Patent
Kataoka

(10) Patent No.: US 11,794,487 B2
(45) Date of Patent: Oct. 24, 2023

(54) THERMAL PRINTER

(71) Applicant: TOSHIBA TEC KABUSHIKI KAISHA, Tokyo (JP)

(72) Inventor: Mitsuhiro Kataoka, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 383 days.

(21) Appl. No.: 17/126,211

(22) Filed: Dec. 18, 2020

(65) Prior Publication Data

US 2021/0221147 A1 Jul. 22, 2021

(30) Foreign Application Priority Data

Jan. 16, 2020 (JP) ..... 2020-005276

(51) Int. Cl.
*B41J 2/365* (2006.01)
*B41J 2/045* (2006.01)
*B41J 2/355* (2006.01)

(52) U.S. Cl.
CPC ..... *B41J 2/3556* (2013.01); *B41J 2/04563* (2013.01); *B41J 2/365* (2013.01)

(58) Field of Classification Search
CPC ..... B41J 2/3556; B41J 2/04563; B41J 2/365
See application file for complete search history.

(56) References Cited

U.S. PATENT DOCUMENTS

2001/0028384 A1* 10/2001 Kidoura ..... B41J 2/365 347/195
2005/0068403 A1 3/2005 Okuchi et al.
2014/0002566 A1* 1/2014 Takahashi ..... B41J 2/32 347/171

FOREIGN PATENT DOCUMENTS

JP 2569898 B2 * 1/1997 ..... B41J 2/36

OTHER PUBLICATIONS

Japanese Office Action for Japanese Patent Application No. 2020-005276 dated Jul. 4, 2023.

* cited by examiner

*Primary Examiner* — Yaovi M Ameh
(74) *Attorney, Agent, or Firm* — AMIN, TUROCY & WATSON, LLP

(57) ABSTRACT

A thermal printer according to one embodiment includes a thermal head, a temperature sensor, and a control unit. The thermal head includes a plurality of heating elements. The temperature sensor is provided in the thermal head and is configured to measure a temperature of the thermal head. The control unit is configured to control an amount of heat generated from the heating elements by determining a pulse supply time for which a pulse signal is supplied to the thermal head based on the temperature of the thermal head and a cumulative heat generation time of the thermal head.

17 Claims, 7 Drawing Sheets

FIG. 9

| PULSE SUPPLY TIME | PRINT DOT RATIO | HEAT GENERATION ADDITION TIME |
|---|---|---|
| 100 μs | 0% | 0 μs |
| | 50% | 50 μs |
| | 100% | 100 μs |

THERMAL PRINTER

CROSS-REFERENCE TO RELATED APPLICATION

This application is based upon and claims the benefit of priority from Japanese Patent Application No. 2020-005276, filed on Jan. 16, 2020, the entire contents of which are incorporated herein by reference.

FIELD

Embodiments described herein relate generally to a thermal printer, a POS terminal including the thermal printer, and methods associated therewith.

BACKGROUND

In the related art, a thermal printer that executes printing on heat-sensitive paper using a thermal head is disclosed. If continuous printing is executed in the thermal printer, the temperature of the thermal head itself increases due to printing on the previous line. Therefore, the temperature of the thermal head increases to be higher than a desired heat generation temperature, and an image quality deterioration phenomenon such as tailing in which a portion of the heat-sensitive paper outside a desired region is colored may occur. On the other hand, a technique of mounting a temperature sensor such as a thermistor on the thermal head, and determining the heat generation time of the thermal head based on the measured temperature of the thermal head is known.

However, the temperature of the thermal head at the time of heat generation may change from the temperature at the time of measurement. Here, if the heat generation time determined based on the temperature of the thermal head at the time of measurement is used, the thermal head is excessively heated, and the printing quality may deteriorate.

DESCRIPTION OF THE DRAWINGS

FIG. 9 is a diagram illustrating another example of heat generation time adjustment according to the embodiment.

DETAILED DESCRIPTION

Embodiments provide a technique of appropriately determining the heat generation time of a thermal head.

A thermal printer according to one embodiment includes a thermal head, a temperature sensor, and a control unit. The thermal head includes a plurality of heating elements. The temperature sensor is provided in the thermal head and is configured to measure a temperature of the thermal head. The control unit is configured to control an amount of heat generated from the heating elements by determining a pulse supply time for which a pulse signal is supplied to the thermal head based on the temperature of the thermal head and a cumulative heat generation time of the thermal head. According to another embodiment, a method for a thermal printer involves supplying a pulse signal to a thermal head including a plurality of heating elements; measuring a temperature of a thermal head; and controlling an amount of heat generated from the plurality of heating elements by determining a pulse supply time for which the pulse signal is supplied to the thermal head based on the temperature of the thermal head measured and a cumulative heat generation time of the thermal head.

Hereinafter, a thermal printer according to an embodiment will be described in detail with reference to the drawings. The invention is not limited to the embodiment described below.

Figure 1:
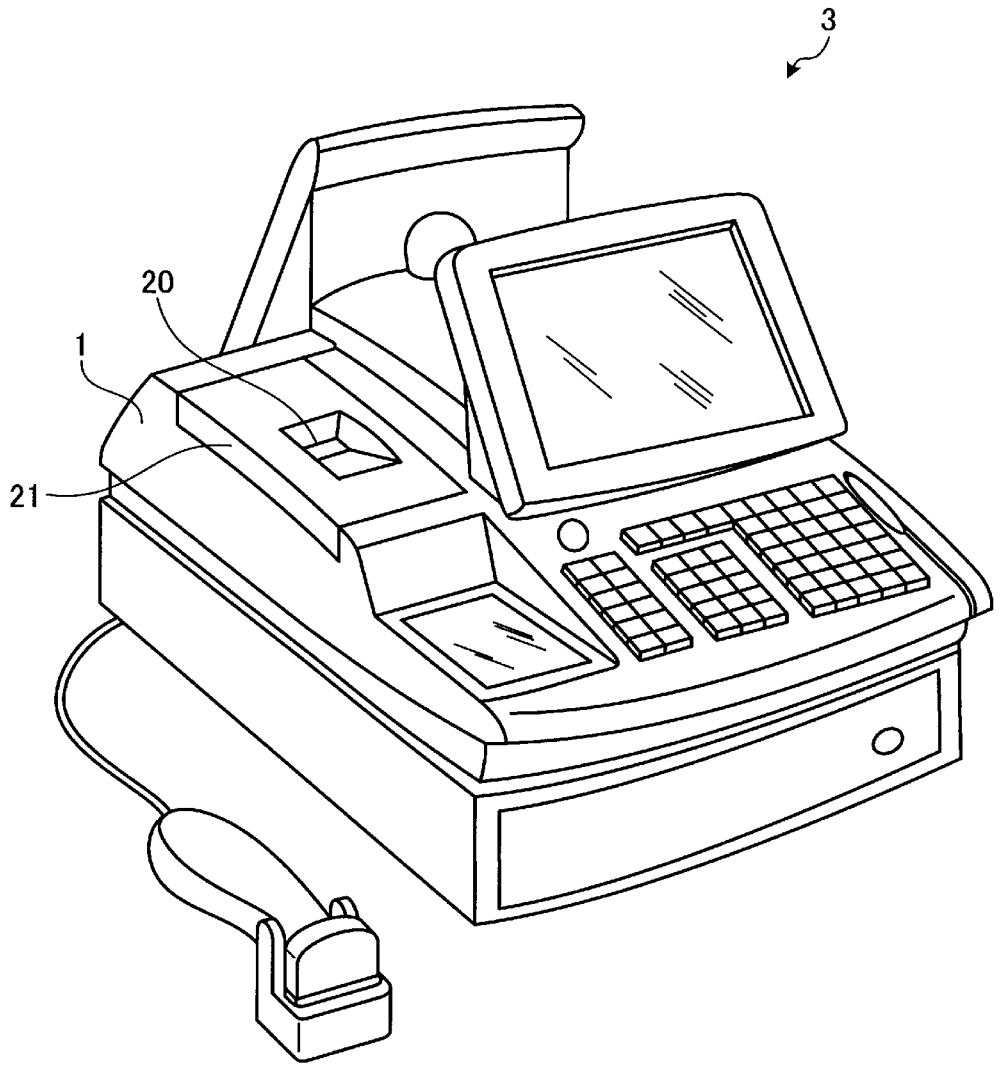
FIG. 1 is a diagram illustrating an example of an external appearance of a point of sale (POS) terminal on which a thermal printer according to an embodiment is mounted.

FIG. 1 is a diagram illustrating an example of an external appearance of a point of sale (POS) terminal 3 on which a thermal printer 1 according to the embodiment is mounted. The POS terminal 3 is provided in a shop or the like and is operated by an operator such as a clerk. The POS terminal 3 is configured to be capable of communication with a shop server through a network.

As illustrated in FIG. 1, the thermal printer 1 described in the embodiment is a receipt printer that is mounted on the POS terminal 3 to issue a receipt. The thermal printer 1 includes a lid 21 in an upper portion.

Figure 2:
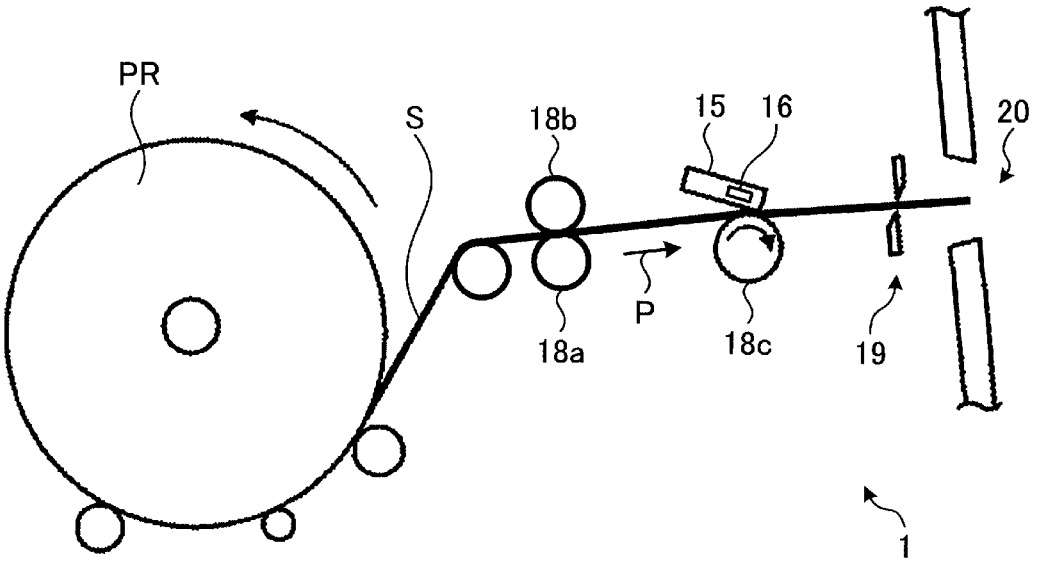
FIG. 2 is a diagram illustrating an example of an internal configuration of the thermal printer.

FIG. 2 is a diagram illustrating an example of an internal configuration of the thermal printer 1 according to the embodiment. As illustrated in FIG. 2, the thermal printer 1 includes a thermal head 15, a conveying roller 18*a*, a pinch roller 18*b*, a platen roller 18*c*, a cutting unit 19, and a discharge port 20.

The thermal printer 1 is configured such that roll paper PR (thermal roll paper) is attachable and detachable thereto or therefrom. The roll paper PR is a roll-shaped printing medium where continuous paper S is wound. The continuous paper S is a strip-shaped paper. The continuous paper S is colored from a transparent color to a visible color (for example, black) due to heat generated from heating elements 15*a* of the thermal head 15 that is heated to a predetermined temperature or higher. That is, the continuous paper S itself is colored on the condition that the thermal head 15 has a predetermined coloring temperature or higher.

Figure 4:
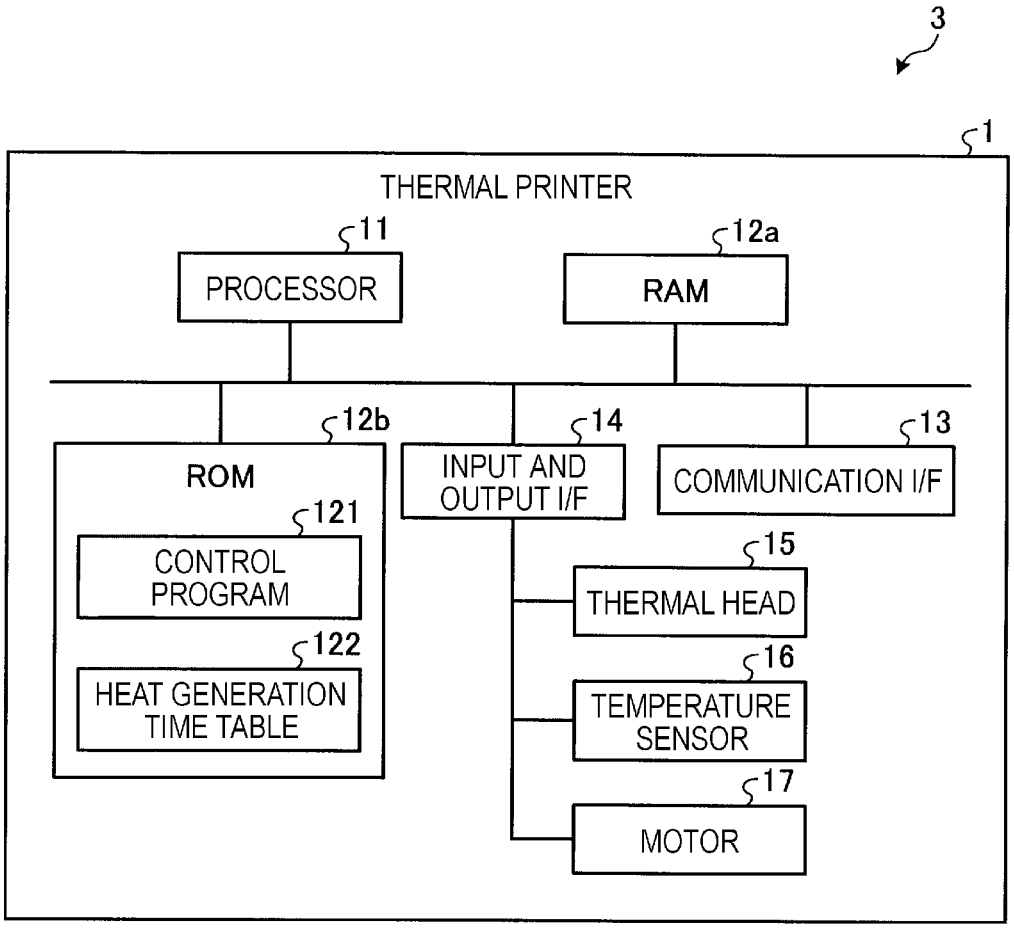
FIG. 4 is a block diagram illustrating an example of a configuration of the thermal printer.

The conveying roller 18*a* is rotatable and attached to a frame or the like and rotates due to power of a motor 17 (refer to FIG. 4). The pinch roller 18*b* is provided at a position facing the conveying roller 18*a*. The pinch roller 18*b* is biased by a plate spring or the like to be pressed against the conveying roller 18*a*. The conveying roller 18*a* and the pinch roller 18*b* interposes the continuous paper S pulled from the roll paper PR and conveys the continuous paper S in a direction indicated by an arrow P.

The thermal head 15 and the platen roller 18*c* interpose the conveyed continuous paper S. The thermal head 15 is a thermal printer head that prints information such as transaction details on the continuous paper S interposed between the thermal head 15 and the platen roller 18*c*. The platen roller 18*c* is rotatable and attached to a frame or the like and rotates due to power of the motor 17 (refer to FIG. 4). If the platen roller 18*c* rotates, the pulled continuous paper S is conveyed in a direction of the discharge port 20.

Figure 3:
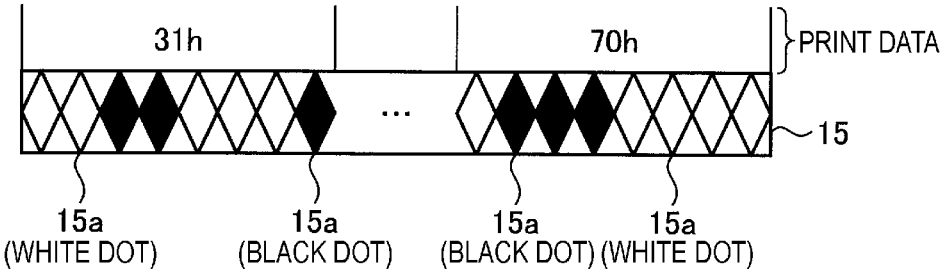
FIG. 3 is a schematic diagram illustrating an example of a configuration of a thermal head according to the embodiment.

FIG. 3 is a schematic diagram illustrating an example of a configuration of the thermal head 15 according to the embodiment. As illustrated in FIG. 3, in the thermal head 15, a plurality of heating elements 15*a* corresponding to one line of pixels are arranged in a straight line. The thermal head 15 is configured to print one raster by heat generated from the respective heating elements 15*a*. Here, the line is a group of pixels having the same sub-scanning position in print data. The raster is printing corresponding to the line.

In the example illustrated in FIG. 3, heating elements 15*a* that are energized to generate heat are illustrated as black dots, and heating elements 15*a* that do not generate heat are illustrated as white dots. Print data illustrated in FIG. 3 is represented by hexadecimal numbers using heat generation and non-heat generation of eight heating elements 15*a*. That is, "31*h*" illustrates "00110001", and "70*h*" illustrates "01110000". "1" and "0" correspond a black dot and a white dot, respectively. Therefore, the heating element 15*a* corresponding to print data of each line among the heating elements 15*a* generates heat.

Specifically, a pulse (strobe pulse) signal is supplied to each of the heating elements 15*a*. Among the heating elements 15*a* arranged in the thermal head 15, a pulse signal, that is supplied to a gate terminal of a transistor connected to the heating element 15*a* (black dot) used for printing, switches from Low to High or from High to Low at a timing at which heat starts to be generated. A current starts to flow through each of the heating elements 15 according to rise or fall of the pulse. If a current flows through each of the heating elements 15*a*, the heating element 15*a* generates heat.

Here, the description continues with reference to FIG. 2 again. The cutting unit 19 is a cutter that cuts a printed portion (for example, a portion as a receipt) from the continuous paper S. FIG. 2 illustrates a slide cutter as an example of the cutting unit 19. However, another configuration such as a roller cutter can also be appropriately used. The printed receipt (continuous paper S) is discharged from the discharge port 20. In the example illustrated in FIG. 1, the discharge port 20 is formed in the lid 21.

For example, the thermal printer 1 is built in the POS terminal 3 but may include a housing different from the POS terminal 3 and be formed independently.

The technique according to the embodiment is not limited to the receipt printer and is applicable to, for example, various thermal recording type or thermal transfer recording type printing apparatus including a label printer that executes printing on a label.

The external appearance and the internal configuration illustrated in FIGS. 1 and 2 are merely exemplary and can be modified in various ways.

FIG. 4 is a block diagram illustrating an example of the configuration of the thermal printer 1 according to the embodiment. As illustrated in FIG. 4, the thermal printer 1 further includes a processor 11, a random access memory (RAM) 12*a*, a read only memory (ROM) 12*b*, a communication I/F 13, an input and output I/F 14, a temperature sensor 16, and the motor 17. The processor 11, the RAM 12*a*, the ROM 12*b*, the communication I/F 13, and the input and output I/F 14 are connected to each other to be capable of communication through a bus line or the like.

The processor 11 controls an overall operation of the thermal printer 1. The processor 11 loads a control program 121 stored in the ROM 12*b* to the RAM 12*a* and executes the loaded control program 121 to control the operation of the thermal printer 1. As the processor 11, for example, a central processing unit (CPU) is used. However, another processor such as a graphics processing unit (GPU), an application specific integrated circuit (ASIC), or a field programmable gate array (FPGA) may be used.

The RAM 12*a* is a volatile memory that is used as a working memory and stores data if the processor 11 executes arithmetic processing. The ROM 12*b* is a nonvolatile memory that stores data such as a parameter or each of programs including the control program 121 that is executed by the processor 11. The ROM 12*b* stores a heat generation time table 122.

The heat generation time table 122 is a table for determining the amount of heat generated from the thermal head 15. The heat generation time table 122 shows a relationship between the temperature of the thermal head 15 and the heat generation time. In the heat generation time table 122, as the temperature of the thermal head 15 increases, the heat generation time decreases. Here, the heat generation time of the thermal head 15 is a period of time for which the pulse (strobe pulse) signal is supplied to the thermal head 15. Accordingly, the heat generation time table 122 shows a relationship between the temperature of the thermal head 15 and the pulse supply time for which the pulse signal is supplied to the thermal head 15. In the heat generation time table 122, as the temperature of the thermal head 15 increases, the pulse supply time decreases.

The thermal printer 1 may include a hard disk drive (HDD), a solid state drive (SSD), or another nonvolatile memory such as a flash memory. Here, the data such as a parameter or each of programs including the control program 121 that is executed by the processor 11 and the heat generation time table 122 may be stored in another nonvolatile memory.

The communication I/F 13 is a communication circuit that communicates with the POS terminal 3. The thermal printer 1 and the POS terminal 3 may be connected in a wired manner through the communication I/F 13 or may be connected in a wireless manner. That is, the communication I/F 13 may be a communication circuit for wired communication or a communication circuit for wireless communication.

The input and output I/F 14 is an interface circuit that is connected to the thermal head 15, the temperature sensor 16, and the motor 17. The input and output I/F 14 includes a head driver that is connected to each of the heating elements 15*a* of the thermal head 15 and energizes and heats each of the heating elements 15*a* (that is, the thermal head 15) by supplying the pulse signal to each of the heating elements 15*a*. The input and output I/F 14 includes a motor driver that is connected to the motor 17 and controls the rotation of the motor 17.

The temperature sensor 16 is disposed in the thermal head 15 and measures the temperature of the thermal head 15. As the temperature sensor 16, for example, a thermistor is used. However, another sensor such as a thermocouple or a resistance thermometer bulb may be used. A radiation thermometer may be used as the temperature sensor 16. Here, the temperature sensor 16 is not necessarily disposed in the thermal head 15.

The motor 17 drives the conveying roller 18*a* and the platen roller 18*c*. As the motor 17, for example, a stepping motor is used. The motor 17 may include a conveyance motor that drives the conveying roller 18*a* and a platen motor that drives the platen roller 18*c* independently.

Figure 5:
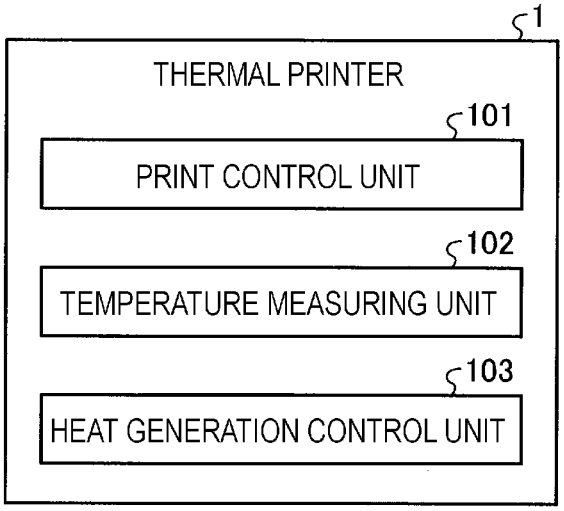
FIG. 5 is a block diagram illustrating an example of a functional configuration of the thermal printer.

FIG. 5 is a block diagram illustrating an example of a functional configuration of the thermal printer 1 according to the embodiment. The processor 11 executes the control program 121 loaded to the RAM 12*a* to implement functions as a print control unit 101, a temperature measuring unit 102, and a heat generation control unit 103.

The print control unit 101 determines whether print data is input from the POS terminal 3 to the communication I/F 13. The print control unit 101 stores the print data input from the POS terminal 3 in the RAM 12*a*. The print control unit 101 generates a pulse signal of each line for printing each raster based on the print data and the pulse supply time determined by the heat generation control unit 103. The print control unit 101 supplies the generated pulse signal of each line to the thermal head 15.

The temperature measuring unit 102 measures the temperature of the thermal head 15 based on the measured value of the temperature sensor 16. For example, the temperature measuring unit 102 starts to measure the temperature of the thermal head 15 in response to the input of the print data from the POS terminal 3. The temperature measuring unit 102 stores the measured temperature of the thermal head 15 (hereinafter, referred to as "temperature Tm") in the RAM 12*a*.

The heat generation control unit 103 determines the pulse supply time for which the pulse signal is supplied to the thermal head 15 based on the temperature Tm measured by the temperature measuring unit 102. Specifically, the heat generation control unit 103 determines the pulse supply time by reading the pulse supply time corresponding to the temperature Tm with reference to the heat generation time table 122.

The heat generation control unit 103 accumulates the heat generation time (pulse supply time) of the thermal head 15 and calculates a cumulative heat generation time. When the cumulative heat generation time is longer than or equal to a predetermined value, the heat generation control unit 103 adjusts a reference source of the heat generation time table 122. Specifically, the heat generation control unit 103 determines the pulse supply time to be shorter than the time corresponding to the temperature Tm by reading a pulse supply time corresponding to a temperature higher than the temperature Tm of the heat generation time table 122. Therefore, the heat generation control unit 103 determines the pulse supply time for which the pulse signal is supplied to the thermal head 15 based on the temperature (the temperature Tm) of the thermal head 15 and the cumulative heat generation time.

If a printing operation is not executed, the heat generation control unit 103 subtracts the cumulative heat generation time per predetermined period of time. The duration of the predetermined period of time or the size of the cumulative heat generation time to be subtracted is, for example, preset and stored in the ROM 12*b* or the like. The duration of the predetermined period of time or the size of the cumulative heat generation time to be subtracted may change depending on the kind of the continuous paper S, the temperature Tm, the ambient temperature of the thermal head 15, and the like.

Hereinafter, processes that are executed by the thermal printer 1 according to the embodiment will be described with reference to the drawing.

Figure 6:
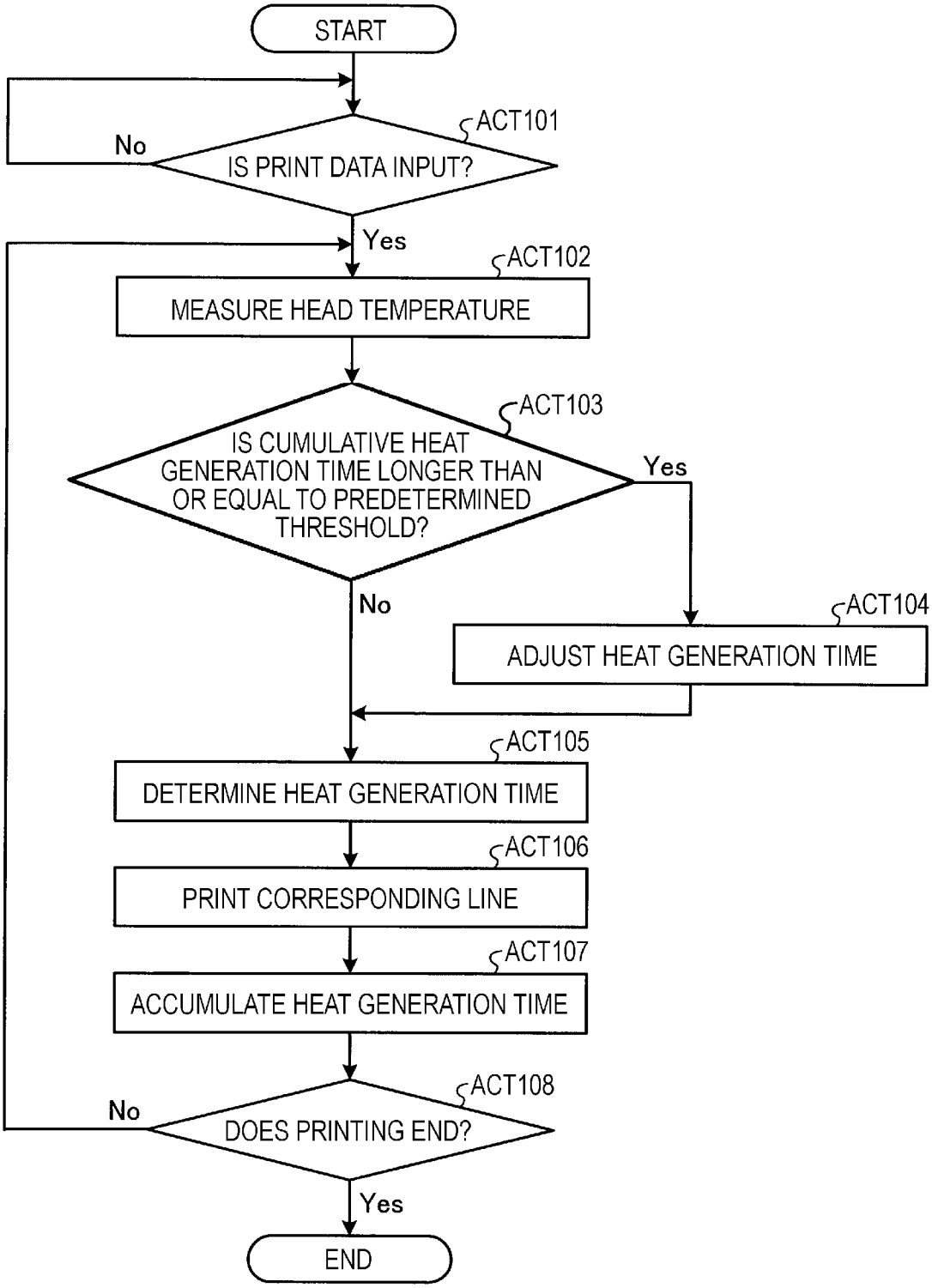
FIG. 6 is a flowchart illustrating an example of processes that are executed by the thermal printer.

FIG. 6 is a flowchart illustrating an example of the processes that are executed by the thermal printer 1 according to the embodiment.

The print control unit 101 determines whether print data is input from the POS terminal 3 to the communication I/F 13 (ACT 101). If the print data is not input from the POS terminal 3 (ACT 101: No), the print control unit 101 waits.

On the other hand, if the print data is input from the POS terminal 3 (ACT 101: Yes), the print control unit 101 stores the print data input from the POS terminal 3 in the RAM 12*a*. The temperature measuring unit 102 acquires an output of the temperature sensor 16 through the input and output I/F 14 and measures the temperature Tm of the thermal head 15 based on the acquired output of the temperature sensor 16 (ACT 102). The temperature measuring unit 102 stores the temperature Tm in the RAM 12*a*.

The heat generation control unit 103 determines whether the cumulative heat generation time of the thermal head 15 is longer than or equal to a predetermined threshold (ACT 103). The predetermined threshold is, for example, preset and stored in the ROM 12*b* or the like.

Figure 7:
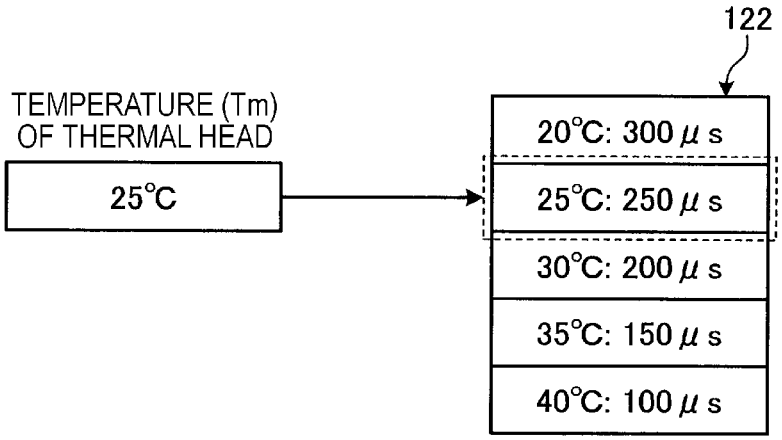
FIG. 7 is a diagram illustrating a heat generation time table according to the embodiment.

When the cumulative heat generation time of the thermal head 15 is shorter than the predetermined threshold (ACT 103: No), the heat generation control unit 103 determines the heat generation time of the thermal head 15 based on the temperature Tm (ACT 105). FIG. 7 is a diagram illustrating the heat generation time table 122 according to the embodiment. The heat generation control unit 103 determines the pulse supply time to the thermal head 15 based on the temperature Tm with reference to the heat generation time table 122. In the example illustrated in FIG. 7, since the temperature Tm is 25° C., the heat generation control unit 103 determines the pulse supply time (heat generation time) as 250 μs with reference to the heat generation time table 122. The respective values of the heat generation time table 122 are merely exemplary and are not limited to FIG. 7.

Figure 8:
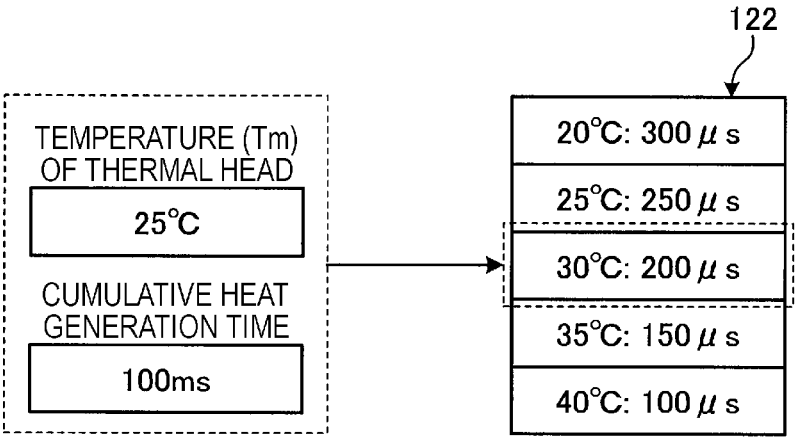
FIG. 8 is a diagram illustrating an example of heat generation time adjustment according to the embodiment.

On the other hand, when the cumulative heat generation time of the thermal head 15 is longer than or equal to the predetermined threshold (ACT 103: Yes), the heat generation control unit 103 adjusts the pulse supply time (heat generation time) (ACT 104). FIG. 8 is a diagram illustrating an example of heat generation time adjustment according to the embodiment. In the example illustrated in FIG. 8, the cumulative heat generation time is 100 ms. Here, a case where the predetermined cumulative heat generation time is shorter than 100 ms will be described as an example, but the embodiment is not limited thereto. The respective values of the heat generation time table 122 are merely exemplary and are not limited to FIG. 8. As illustrated in FIG. 8, the heat generation control unit 103 adjusts the reference source of the heat generation time table 122 to be on a side higher than the temperature Tm. That is, the heat generation control unit 103 determines the pulse supply time to the thermal head 15 based on the temperature Tm and the cumulative heat generation time with reference to the heat generation time table 122 (ACT 105). In the example illustrated in FIG. 8, since the temperature Tm is 25° C., the heat generation control unit 103 determines the pulse supply time (heat generation time) as 200 μs with reference to the heat generation time table 122 on the side higher than 25° C.

The print control unit 101 executes printing of the corresponding line (ACT 106). Specifically, the print control unit 101 generates a pulse (strobe pulse) signal based on the print data and the pulse supply time determined by the heat generation control unit 103 and supplies the generated pulse signal to the thermal head 15.

The heat generation control unit 103 adds the pulse supply time regarding the printing of the corresponding line to the cumulative heat generation time (ACT 107).

Next, the print control unit 101 determines whether the printing ends (ACT 108). When printing regarding all the lines in the print data input in ACT 101 does not end (ACT 108: No), the flow of FIG. 6 returns to ACT 102. On the other hand, when printing regarding all the lines in the print data input in ACT 101 ends (ACT 108: yes), the flow of FIG. 6 ends.

Therefore, the thermal printer 1 according to the embodiment controls the amount of heat generated from the heating elements 15*a* by determining the pulse supply time for which the pulse signal is supplied to the thermal head 15 based on the temperature (the temperature Tm) of the thermal head 15 and the cumulative heat generation time of the thermal head 15. Specifically, when the cumulative heat generation time of the thermal head 15 is longer than or equal to the predetermined threshold, the heat generation control unit 103 adjusts the pulse supply time to be shorter than the time determined based on the measured temperature (the temperature Tm) of the thermal head 15. With such configuration, the heat generation time of the thermal head 15 can be appropriately determined. That is, when the printing of the next line starts while thermal head 15 is not completely cooled, the heat generation time relating to the printing of the next line is set to be short. As a result, the generation of an excess amount of heat caused by heat storage of the thermal head 15 can be prevented, and deterioration in printing quality, for example, the occurrence of tailing can be prevented.

As described above, in the thermal head 15, only heating elements 15*a* (black dots) used for printing among all the heating elements 15*a* generate heat. That is, the heat storage in the thermal head 15 depends on the proportion (hereinafter, referred to as "print dot ratio") of the heating elements 15*a* (black dots) used for printing among all the heating elements 15*a*. Thus, the cumulative heat generation time may be calculated according to the print dot ratio.

FIG. 9 is a diagram illustrating another example of heat generation time adjustment according to the embodiment. In the description of the embodiment, when the pulse supply time is 100 μs, 100 μs is added (ACT 107) to the cumulative heat generation time. On the other hand, in the example illustrated in FIG. 9, the heat generation control unit 103 adds a time (heat generation addition time) to the cumulative heat generation time, the time being obtained by multiplying the pulse supply time by the print dot ratio (ACT 107). For example, when the pulse supply time is 100 μs and the print dot ratio is 50%, the heat generation control unit 103 adds 50 μs as the heat generation addition time to the cumulative heat generation time. With such configuration, the cumulative heat generation time corresponding to the actual heat generation density from the thermal head 15 can be calculated. That is, the heat generation time of the thermal head 15 can be more appropriately determined.

The amount of adjustment of the reference source of the heat generation time table 122 may be predetermined or may be obtained according to the cumulative heat generation time. The amount of adjustment corresponding to the cumulative heat generation time increases as the cumulative heat generation time increases. For example, as illustrated in FIG. 8, if the cumulative heat generation time is 100 ms, the heat generation control unit 103 refers to a temperature higher than the temperature Tm by 5° C., and when the cumulative heat generation time is 200 ms, the heat generation control unit 103 refers to a temperature higher than the temperature Tm by 10° C. Of course, the cumulative heat generation time and the amount of adjustment of the reference source is not limited to the linear relationship and may be a nonlinear relationship.

The amount of adjustment of the reference source of the heat generation time table 122 may be obtained according to the kind of the continuous paper S or the environmental temperature (the ambient temperature of the thermal head 15).

Instead of the heat generation time table 122, a relational expression showing a relationship between the temperature Tm and the pulse supply time may be used. As in the heat generation time table 122, the relational expression may be preset and stored in, for example, the ROM 12*b* or the like.

The heat generation time table 122 may further include a field regarding the cumulative heat generation time. That is, the heat generation time table 122 may show a relationship between the measured temperature (the temperature Tm) of the thermal head 15, the cumulative heat generation time, and the pulse supply time (the heat generation time). Likewise, a relational expression showing a relationship between the temperature Tm, the cumulative heat generation time, and the pulse supply time (the heat generation time) may also be used.

The flows of ACT 103 and ACT 104 may be executed after ACT 105. That is, when the cumulative heat generation time is the threshold or longer (ACT 103: Yes) after determining (ACT 105) the pulse supply time based on the temperature Tm, the determined pulse supply time may be adjusted (ACT 104).

According to at least one of the above-described embodiments, the heat generation time of the thermal head 15 can be appropriately determined.

The control program 121 that is executed by the thermal printer 1 according to the embodiment is provided in a form in which it is incorporated into the ROM 13 or the like in advance.

The control program 121 that is executed by the thermal printer 1 according to the embodiment may be provided by being recorded in a computer-readable recording medium such as a CD-ROM, a flexible disk (FD), a CD-R, or a digital versatile disk (DVD) in a file format that is installable or executable.

The control program 121 that is executed by the thermal printer 1 according to the embodiment may be provided by storing the program in a computer connected to a network such as the Internet and downloading the program through the network. The control program 121 that is executed by the thermal printer 1 according to the embodiment may be provided or distributed through a network such as the Internet.

The control program 121 that is executed by the thermal printer 1 according to the embodiment has a module configuration including the above-described respective units (the print control unit 101, the temperature measuring unit 102, and the heat generation control unit 103). The processor 11 such as a CPU reads the control program 121 from the storage medium and loads the respective units to a main memory device. As a result, the print control unit 101, the temperature measuring unit 102, and the heat generation control unit 103 are generated on the main memory device.

While certain embodiments have been described, these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such embodiments or modifications as would fall within the scope and spirit of the invention.

What is claimed is:

1. A thermal printer, comprising:

a thermal head including a plurality of heating elements;

a temperature sensor configured to measure a temperature of the thermal head, the temperature sensor being provided in the thermal head; and a controller configured to control an amount of heat generated from the plurality of heating elements by determining a pulse supply time for which a pulse signal is supplied to the thermal head based on the temperature of the thermal head measured by the temperature sensor and a cumulative heat generation time of the thermal head, wherein when a printing operation is not executed, the controller subtracts the cumulative heat generation time per predetermined period of time.

2. The thermal printer according to claim 1, wherein when the cumulative heat generation time is longer than or equal to a predetermined threshold, the controller decreases the pulse supply time to be shorter than a time determined based on the temperature of the thermal head.

3. The thermal printer according to claim 2, further comprising:

a storage component configured to store a table showing a relationship between the temperature of the thermal head and the pulse supply time, wherein when the cumulative heat generation time is longer than or equal to a predetermined threshold, the controller adjusts a reference source of the table to be on a side higher than the temperature of the thermal head.

4. The thermal printer according to claim 3, wherein the table is a heat generation time table, the heat generation time table indicates as the temperature of the thermal head increases, the pulse supply time decreases.

5. The thermal printer according to claim 1, wherein the controller adds a time to the cumulative heat generation time, the time being obtained by multiplying a proportion of heating elements used for printing among the heating elements by the pulse supply time.

6. The thermal printer according to claim 1, wherein the plurality of heating elements are arranged in a straight line.

7. The thermal printer according to claim 1, wherein the temperature sensor comprises a thermistor.

8. A method for a thermal printer, comprising:

supplying a pulse signal to a thermal head including a plurality of heating elements;

measuring a temperature of a thermal head; and controlling an amount of heat generated from the plurality of heating elements by determining a pulse supply time for which the pulse signal is supplied to the thermal head based on the temperature of the thermal head measured and a cumulative heat generation time of the thermal head, wherein when a printing operation is not executed, subtracting the cumulative heat generation time per predetermined period of time.

9. The method according to claim 8, further comprising:

when the cumulative heat generation time is longer than or equal to a predetermined threshold, decreasing the pulse supply time to be shorter than a time determined based on the temperature of the thermal head.

10. The method according to claim 9, further comprising:

storing a table showing a relationship between the temperature of the thermal head and the pulse supply time; and when the cumulative heat generation time is longer than or equal to a predetermined threshold, adjusting a reference source of the table to be on a side higher than the temperature of the thermal head.

11. A POS terminal, comprising:

a roll paper holder;

a plurality of rollers;

a discharge port; and a thermal printer, comprising:

a thermal head including a plurality of heating elements;

a temperature sensor configured to measure a temperature of the thermal head, the temperature sensor being provided in the thermal head; and a controller configured to control an amount of heat generated from the plurality of heating elements by determining a pulse supply time for which a pulse signal is supplied to the thermal head based on the temperature of the thermal head measured by the temperature sensor and a cumulative heat generation time of the thermal head, wherein when a printing operation is not executed, the controller subtracts the cumulative heat generation time per predetermined period of time.

12. The POS terminal according to claim 11, wherein when the cumulative heat generation time is longer than or equal to a predetermined threshold, the controller decreases the pulse supply time to be shorter than a time determined based on the temperature of the thermal head.

13. The POS terminal according to claim 12, further comprising:

a storage component configured to store a table showing a relationship between the temperature of the thermal head and the pulse supply time, wherein when the cumulative heat generation time is longer than or equal to a predetermined threshold, the controller adjusts a reference source of the table to be on a side higher than the temperature of the thermal head.

14. The POS terminal according to claim 13, wherein the table is a heat generation time table, the heat generation time table indicates as the temperature of the thermal head increases, the pulse supply time decreases.

15. The POS terminal according to claim 11, wherein the controller adds a time to the cumulative heat generation time, the time being obtained by multiplying a proportion of heating elements used for printing among the heating elements by the pulse supply time.

16. The POS terminal according to claim 11, wherein the plurality of heating elements are arranged in a straight line.

17. The POS terminal according to claim 11, wherein the temperature sensor comprises a thermistor.

* * * * *